United States Patent [19]

Marker

[11] Patent Number: 4,667,615

[45] Date of Patent: May 26, 1987

[54] SAILBOARD CENTERBOARD

[76] Inventor: Hannes Marker, Alpspitzstr. 37, Garmisch-Partenkirchen, Fed. Rep. of Germany

[21] Appl. No.: 799,116

[22] PCT Filed: Feb. 21, 1985

[86] PCT No.: PCT/EP85/00062

§ 371 Date: Nov. 13, 1985

§ 102(e) Date: Nov. 13, 1985

[87] PCT Pub. No.: WO85/04143

PCT Pub. Date: Sep. 26, 1985

[30] Foreign Application Priority Data

Mar. 13, 1984 [DE] Fed. Rep. of Germany ..... 3409157

[51] Int. Cl.[4] ..... B63B 41/00

[52] U.S. Cl. ..... 114/132; 441/79

[58] Field of Search ..... 114/39.2, 127, 130, 114/131, 132–137, 140; 441/79

[56] References Cited

U.S. PATENT DOCUMENTS 2,466,006 4/1949 Danko ..... 114/138

FOREIGN PATENT DOCUMENTS

| | | | |
|---|---|---|---|
| 88430 | 9/1983 | European Pat. Off. | 441/79 |
| 2659297 | 3/1978 | Fed. Rep. of Germany . | |
| 2746756 | 4/1978 | Fed. Rep. of Germany | 441/79 |
| 2802058 | 7/1979 | Fed. Rep. of Germany | 114/132 |
| 2801738 | 8/1979 | Fed. Rep. of Germany | 114/132 |
| 2932750 | 3/1981 | Fed. Rep. of Germany | 114/130 |
| 3027624 | 2/1982 | Fed. Rep. of Germany | 114/132 |

*Primary Examiner*—Sherman D. Basinger
*Assistant Examiner*—Stephen P. Avila
*Attorney, Agent, or Firm*—Fleit, Jacobson, Cohn & Price

[57] ABSTRACT

A sailboard including a centerboard contained in a housing and which may be pivoted by the foot of the user from the upper face of the sail-board. In order to provide a simple and inexpensive actuation device for the center-board and which practically prevents any possibility of injury, the center-board is provided with a pawl which may be inserted into one of the ratchet recesses provided on or in the housing of the center-board. The pawl is carried by a slide which may be radially displaced in the centerboard with respect to the axis thereof. The outer end of the slide is provided with an actuation member and a spring holds its ratchet position. When the center-board occupies a middle position, the slide is approximately perpendicular to the surface of the sailboard.

11 Claims, 4 Drawing Figures

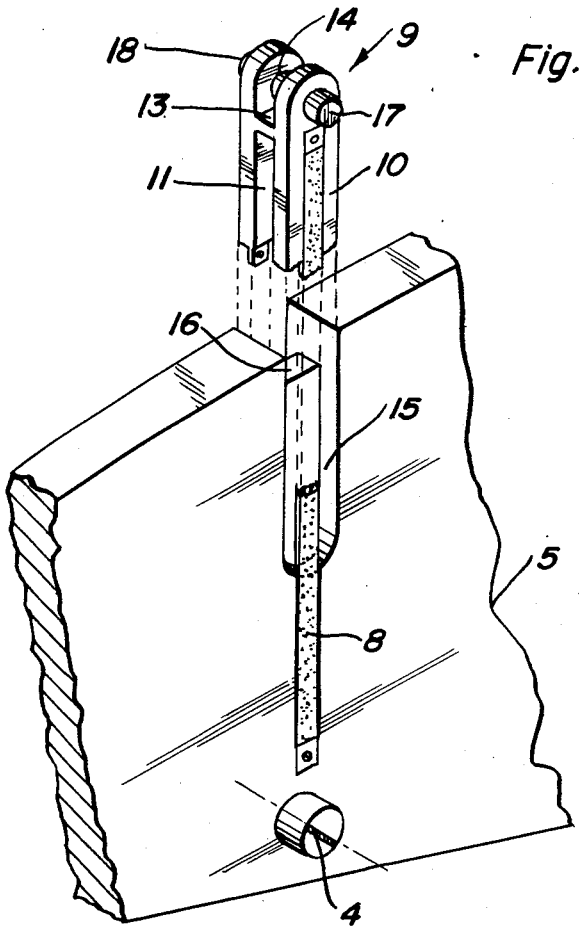
Fig.3
Fig.4
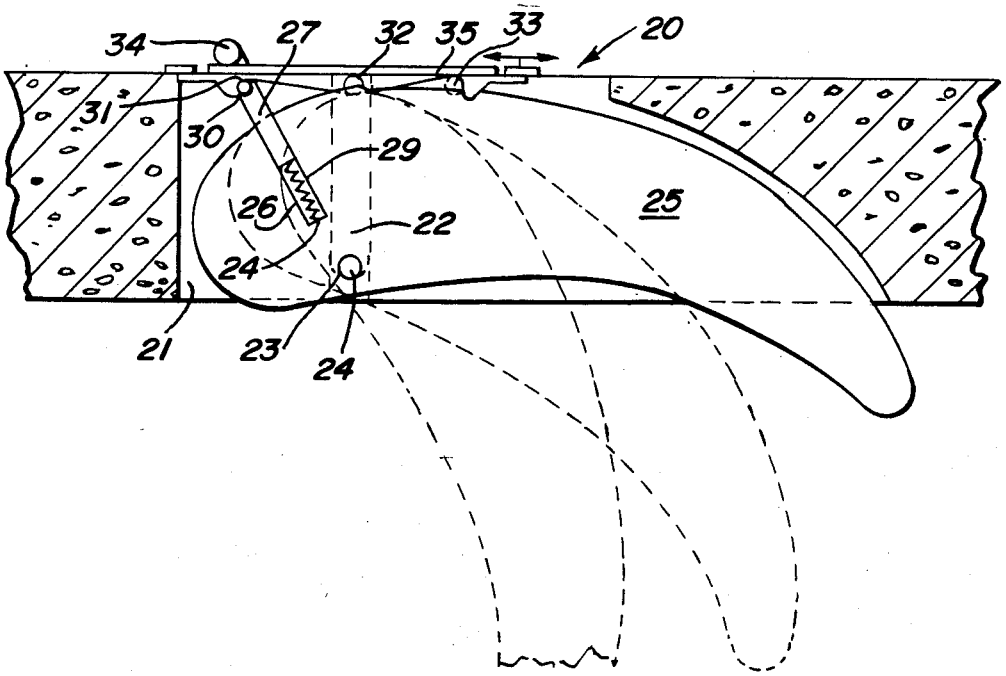

SAILBOARD CENTERBOARD

DESCRIPTION

This invention relates to sailboards comprising a centerboard, which is pivoted in a centerboard box and is adjustable, e.g., by operation with a foot, from the top of the sailboard.

Various embodiments of such sail boards are known (see, e.g., German Patent Specification No. 26 59 297 and Published German Application No. 30 27 624). Compared with other known sailboards they have the special advantage that the centerboard can readily be moved to any desired angular position by means of the foot while the sailboard is sailing, and the centerboard will subsequently remain in position.

Those known embodiments, in which humps are provided at the head of the centerboard, are undesirable and dangerous because the humps protrude to a large extent above the top of the sailboard so that they disturb the maneuvers of the surfer and may be a cause of an injury to the surfer when he falls on the sailboard.

Known embodiments in which adjusting devices engage the head of the centerboard are liable to be deranged owing to the presence of such devices and cannot be made at low cost. It is believed that this is the reason why they have not yet been accepted in practice.

For this reason, it is an object of the invention so to improve and design a sailboard which is of the kind concerned that the means for adjusting the centerboard are simple and inexpensive, and will virtually not hinder the maneuvers of the surfer and will not involve a risk of injury.

This is acccomplished in accordance with the present invention. Regardless of the angular position of the centerboard, the extent to which the actuating element protrudes above the top of the sailboard will not change so that there is no risk of injury or an obstruction to the surfer at any time. The latching ensures that the centerboard will reliably be held in its adjusted angular position.

In a sailboard which is provided in the side walls of the centerboard box with bearings for two stub axles, which constitute the pivot of the centerboard, it has been found to be desirable to provide an arrangement in which the bearings support the stub axles (4) in their upper portions, the latch openings are provided in the upper edge portion of the centerboard box, and the slider is held at its seat by a tension spring so that the latching member is releasably locked in a latch opening. The stress of the tension spring is so selected that the stub axles will be held in the bearings by an adequate force in all positions of the centerboard.

The bearings are suitably disposed in the lower portion of the centerboard box so that the tension spring has an adequate length. The stub axles are also suitably disposed in the lower forward edge portion of the centerboard.

In accordance with a further feature of the invention, the side walls of the centerboard box are provided with grooves for guiding the stub axles and said grooves extend approximately transversely to the top and bottom edges of the centerboard box and are adjoined by the laterally offset bearings, which are downwardly open. In that case the centerboard can simply be inserted into the centerboard box from above and it is then sufficient to push the stub axles into the bearings and to lock the slider at the edges of the centerboard box. The slider may be U-shaped and may straddle to top of the centerboard and may have legs which are longitudinally slidably guided in lateral grooves provided in the head of the centerboard. Cam-like lateral projections serving as a latching member may be provided, which are disposed adjacent to the top end of the slider and are adapted to snap into the detent opening of the centerboard box.

The tension spring may consist of elastic strips, which are provided at the legs of the slider and are secured at their other ends in grooves provided on the side faces of the centerboard.

The latch openings are suitably distributed over a range which approximately corresponds to a pivotal movement of the centerboard through an angle of 90°.

The bearings may be disposed in front of the guiding grooves on the bow side thereof so that the stub axles can move out of the bearings against the spring force and can enter the guiding grooves when the centerboard encounters a resistance. Damage to the centerboard when it is running aground will thus be avoided.

The invention provides also a sailboard in which bearings for two stub axles which constitute the pivot of the centerboard are provided in the side walls of the centerboard box. In that design, the slider may extend outwardly through a longitudinal slot of the cover rail or between the edge ribs of the centerboard box and may be provided with a knob for pivotally moving the centerboard.

The actuating element, or at least its shell, consists of elastic material, so that the surfer may effect an adjustment even with an unshoed foot and this will not result in pain or even injury.

The inclination of the side faces of the latch openings may be selected to provide for a lower or higher resistance presented by the latching means during the pivotal movement.

The claims are directed to a sailboard and the crux of the invention resides in the specific mounting of the adjustable centerboard in the centerboard box. The same concept may obviously be embodied also in sailboats without departing from the scope of the present invention or the patent protection which is claimed.

Illustrative embodiments of the invention will now be explained in more detail with reference to the drawings, in which FIG. 1 is a central longitudinal sectional view showing the centerboard box and the centerboard, which is locked in three different positions.

FIG. 3 is a perspective view showing the slider, which is connected by rubber strips to the head of the centerboard.

FIG. 4 is a sectional view that is similar to FIG. 1 shows a second illustrative embodiment of a centerboard box and centerboard.

Figure 1:
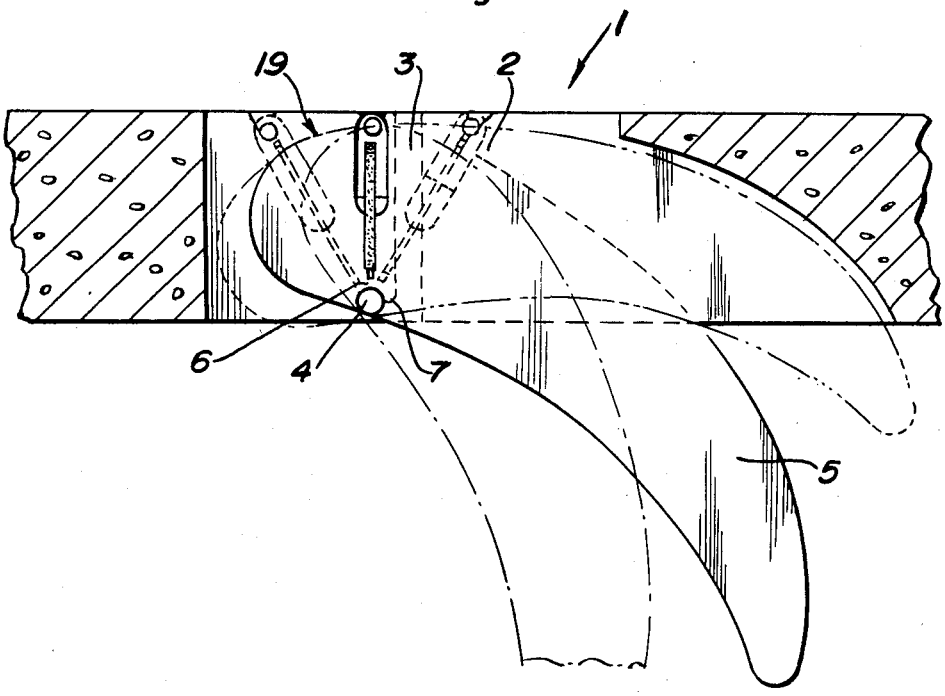
Figure 2:
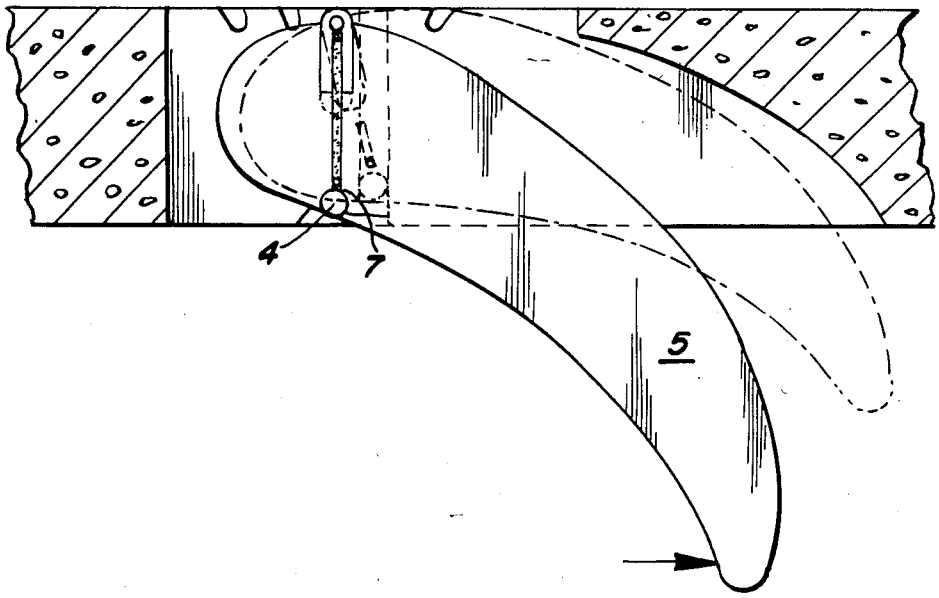
FIG. 2 is a longitudinal sectional view which is similar to FIG. 1 and shows the centerboard box and the centerboard, which is locked in an intermediate position, and is shown in phantom in a position which it assumes when it has run against an obstacle and its stub axles have been raised out of the bearings and received by the slide grooves.

As is apparent from FIGS. 1 and 2, the first illustrative embodiment comprised a centerboard box 1, which in its side walls 2 is provided with mutually opposite grooves 3, which extend at rifght angles to the top and bottom edges and serve to guide two pivot pins 4 of the centerboard 5 when it is inserted into the centerboard box. In the lower portion of the centerboard box 1 its side walls 2 are each provided with opposed, lateral openings, which constitute bearings 6 and are disposed in front of the guiding grooves 3 on the bow side thereof and are separated from the guiding grooves 3 by a rounded nose 7. The bearings 6 are downwardly open and are defined at the top by an approximately semicylindrical, curved wall, which in its intermediate portion has a radius of curvature that is equal to the radius of the pivot pins 4. The guiding grooves 3 and the bearings 6 are defined by surfaces which are parallel to the walls 2 of the centerboard box and have approximately the same depth.

The centerboard 5 has, e.g., a crescent shape so that during a pivotal movement about the pivot pins 4 lying in the bearings 6, the effective surface of the centerboard will be shifted toward the stern of the sailboard and will progressively assume the shape of a fin. The pivot pins 4 are disposed on opposite sides of the centerboard 5 below the head portion adjacent to its forward edge.

As is apparent from FIG. 3, a U-shaped slider 9 is connected to the head portion of the centerboard 5 by means of elastic strips 8, which are secured to both sides of the centerboard. The slider comprises two parallel legs 10, 11, which are interconnected by a crosspiece 13. The legs 10, 11 extend above the crosspiece 13 to form lugs, which are formed with aligned bores, in which a pin 14 is secured, which protrudes on both sides. The side faces of the centerboard 5 are formed with parallel grooves 15, which have longitudinal centerlines intersecting the pivot pins 4. One of the legs 10, 11 is longitudinally slidable in each of the grooves 15, which are separated by an intermediate wall 16, which has a thickness corresponding to the spacing of the legs 10, 11. The legs 10, 11 have such a length that they will sufficiently extend in the grooves 15 in any angular position of the centerboard.

The laterally protruding portions 17, 18 of the pin 14 constitute latching projections, which are adapted to snap into latch openings 19 formed at the top edges of the centerboard box 1. The latch openings 19 extend substantially radially with respect to the bearings 6.

The intermediate portion of the pin 14 and the extension lugs constitute means for connection to an actuating element for pivotally moving the centerboard 5.

The strips 8, of rubber or another elastomeric material, extend in grooves of the centerboard and of the legs 10, 11 of the slider 9 and do not protrude from the grooves.

The strips 8 are under such a high elastic tension that the pivot pins 4 will be reliably held in the bearings 6.

The length of the pin 14 exceeds the distance between the side faces of the guiding grooves 3 so that the centerboard 5 cannot be lost by a slipping of the slider 9 through the guiding grooves 3.

When the centerboard 5 strikes against an object or runs aground and is thus subjected to the action of a force in the direction of the arrow F shown in FIG. 2, the pivot pins 4 can jump over the nose 7 so that the pivot pin 4 and the centerboard 5 assume the position which is shown in phantom and in which the centerboard is almost entirely retracted.

In the illustrative embodiment shown in FIG. 4, the side walls 21 of the centerboard box 20 are formed with mutually opposite guiding grooves 22, which extend at right angles to the top and bottom edges of the centerboard box and are closed by rounded wall portions closely above the bottom edge of the centerboard box 20. Said rounded wall portions constitute bearings 23 for stub axles 24 of the centerboard 25. The centerboard is provided in its head portion with a blind hole 26, in which a slider 27 is slidably guided. That slider is held against rotation. A compression spring 29 is compressed between the slider 27 and the bottom 28 of the blind hole 26. The slider 27 has a top portion, which protrudes above the centerboard 25 and which is provided with a latching member consisting of lateral pins 30, which are adapted to snap into latch openings 31, 32, 33 in dependence on the angular position of the centerboard. Said latch openings are provided on the underside of a cover bar 35 of the centerboard box 20 on both sides of a longitudinal slot. The latch openings 31, 33, which define the end positions, are provided on the inside with inclined guiding surfaces so that the centerboard can easily by pivotally moved toward an intermediate position by means of a knob 34, which is provided on the slider 27 above the cover bar.

I claim:

1. A sailboard comprising: a sailboard body having a top surface and a bottom surface; an elongated centerboard box in said sailboard body to movably receive a centerboard; a centerboard pivoted in the centerboard box and movable from the top of the sailboard, the centerboard inluding latching means for securing the centerboard in a predetermined position, a plurality of latch openings provided in the centerboard box adjacent the top of the sailboard and adapted to receive the latching means, the latching means including a slider mounted in the centerboard for radial displacement relative to a pivotal axis of the centerboard defined by a pair of coaxial, opposed pivot pins extending outwardly from side surfaces of the centerboard, biasing means for urging the latching means into engagement with a latch opening in a centerboard locking position, one of the latch openings positioned relative to the pivot axis so that when the centerboard has been pivotally moved to a position in the middle of the range of its pivotal movement the slider extends substantially at right angles to the top surface of the sailboard body, and the slider is provided at an outer end with actuating means for moving the slider relative to the centerboard to permit selective engagement of the latching means with one of the latch openings.

2. A sailboard according to claim 1, in which the centerboard box includes a pair of opposed side walls provided with bearing means for pivotally receiving the pivot pins of the centerboard, wherein the bearing means support the pivot pins for rotation therewithin, the latch openings are provided in an upper edge portion of the centerboard box, and the biasing means includes a tension spring for moving the slider so that the latching means is releasably received in a latch opening.

3. A sailboard according to claim 2, wherein the side walls of the centerboard box include opposed guiding grooves for receiving and guiding the pivot pins and said grooves extend approximately transversely to top and bottom edges of the centerboard box, the bearing means including circular bearing surfaces spaced from the grooves and facing downwardly.

4. A sailboard according to claim 3, including a rounded nose positioned between the guiding grooves and the bearing means.

5. A sailboard according to claim 2, wherein the slider is U-shaped and straddles the top of the centerboard and has legs which are longitudinally slidably guided in a pair of opposed grooves provided in the sides of the centerboard, and camlike, outwardly extending lateral projections are provided adjacent to the top end of the slider and are received in the latch openings in the edge portion of the centerboard box.

6. A sailboard according to claim 2, wherein the tension spring includes elastic strips secured at one end thereof to the slider and at the other end are secured to the side faces of the centerboard, the centerboard including a pair of opposed grooves provided in the sides thereof, the elastic strips extending along the center lines of the grooves and secured to the side faces at points at which said center lines extend beyond said grooves.

7. A sailboard according to claim 1, wherein the latch openings are spaced from each other over a range which approximately corresponds to a pivotal movement of the centerboard through an angle of 90°.

8. A sailboard according to claim 3, wherein the bearing means are disposed in front of the guiding grooves on the bow side thereof.

9. A sailboard according to claim 6, wherein the slider includes longitudinal grooves in outer surfaces of the legs and the elastic strips are disposed in the grooves of the slider and of the centerboard and are held flush with the side faces of the centerboard.

10. A sailboard according to claim 1, in which the side walls of the centerboard box are provided with bearing means for receiving the pivot pins of the centerboard, the bearing means defined by lower rounded surface portions of a pair of opposed, open-topped grooves formed in the centerboard box, the centerboard is provided adjacent to its head with a blind hole having its axis passing through an axis defined by the pivot pins, a slider slidably guided against the force of a compression spring carried in the blind hole, and the slider is provided in its upper portion with laterally extending pins to define a latching member, the latching member engageable with the latch openings, the latch openings facing downwardly and provided on the underside of edge ribs defining a cover bar of the centerboard box.

11. A sailboard according to claim 10, wherein the slide extends outwardly through a longitudinal slot of the cover bar and is provided with a knob for manually imparting a pivotal movement to the centerboard.

* * * * *